US005862991A

United States Patent [19]

Willke et al.

[11] Patent Number: 5,862,991

[45] **Date of Patent: *Jan. 26, 1999**

[54] FUEL INJECTION VALVE FOR INTERNAL COMBUSTION ENGINES

[75] Inventors: Clemens Willke, Oberstenfeld; Klaus Franzke, Leonberg; Hartmut Albrodt, Tamm; Norbert Belzner, Heilbronn, all of Germany

[73] Assignee: Robert Bosch GmbH, Stuttgart, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 718,581

[22] PCT Filed: Jan. 17, 1996

[86] PCT No.: PCT/DE96/00053

§ 371 Date: Oct. 2, 1996

§ 102(e) Date: Oct. 2, 1996

[87] PCT Pub. No.: WO96/23968

PCT Pub. Date: Aug. 8, 1996

[30] Foreign Application Priority Data

Feb. 2, 1995 [DE] Germany ..... 19 503 269.1

[51] Int. Cl.[6] ..... B05B 15/00; F02M 61/18

[52] U.S. Cl. ..... 239/397.5; 239/585.4; 239/900

[58] Field of Search ..... 239/585.1–585.4, 239/900, 596, 533.12

[56] References Cited

U.S. PATENT DOCUMENTS

| | | | |
|---|---|---|---|
| 4,502,196 | 3/1985 | Kupper et al. | 239/397.5 X |
| 4,957,241 | 9/1990 | Roger | 239/585.1 X |
| 5,295,627 | 3/1994 | Wahba | 239/585.4 |

FOREIGN PATENT DOCUMENTS

| | | | |
|---|---|---|---|
| 611886 | 8/1994 | European Pat. Off. | 239/533 R |
| 3404709 | 8/1985 | Germany | 239/397.5 |
| 759524 | 10/1956 | United Kingdom | 239/397.5 |

*Primary Examiner*—Kevin Weldon
*Attorney, Agent, or Firm*—Edwin E. Greigg; Ronald E. Greigg

[57] ABSTRACT

When an internal combustion engine is hot, especially in hot starting or during hot idling, outgassing of fuel occurs upstream of the injection port disk and at the injection ports; as a result, because too little fuel is supplied, the running performance is undesirably impaired. The running performance of the engine is therefore intended to be improved by preventing the development of vapor bubbles. By the provision of a transfer element, in the form of a raised body shoulder formed on the valve seat body, that reduces the heat transfer between the valve seat body and the injection port disk, it is accomplished that the injection port disk cools down as a result of the extracted heat of evaporation of the injected fuel, and thus the danger of vapor bubble development at the injection ports or upstream is reduced. The fuel injection valve is especially suitable for fuel injection systems in mixture-compressing internal combustion engines with externally supplied ignition.

19 Claims, 4 Drawing Sheets

FUEL INJECTION VALVE FOR INTERNAL COMBUSTION ENGINES

PRIOR ART

The invention is based on a fuel injection valve for internal combustion engines. A fuel injection valve is already known (German patent disclosure DE 42 21 185 A1) in which at very high engine and fuel temperatures a reduction in the injected fuel quantity (leaning down) occurs, especially on hot starting and during hot idling. This is because the valve housing, the valve seat body and the injection port disk heats up severely, causing vapor bubble development at the injection ports of the injection port disk, which leads to a two-phase flow of liquid fuel and vapor bubbles, with a decreasing fuel quantity per unit of time, through the injection ports. This undesirably affects the running performance of the engine in such a way that nonconcentric engine operation occurs, or the engine even stalls.

ADVANTAGES OF THE INVENTION

The fuel injection valve of the invention, has the advantage over the prior art that especially at very high engine or fuel temperatures the danger of a reduction (leaning down) in the injected fuel quantity is lessened or even avoided entirely in a simple way, so that the running performance of the hot engine is improved, especially in hot starting or hot idling. The at least one transfer element between the valve seat body and the injection port disk lessens the heat transfer from the valve seat body to the injection port disk, or in other words decouples them from one another, so that the heat of evaporation, which is required for evaporating the fuel injected through the injection ports and is drawn from the injection port disk, leads to cooling down of the injection port disk, while a replenishing flow of heat from the valve seat body to the injection port disk is reduced or nearly entirely suppressed by the transfer element. Because the injection port disk is cooler than in known fuel injection valves, vapor bubble development upstream of the injection port disk or at the injection ports is greatly reduced or avoided entirely, and thus especially in hot starting the engine is adequately supplied with fuel for reliable starting and continued operation.

It is advantageous to embody the at least one transfer element as a raised shoulder on the valve seat body, making it possible to reduce the area of contact between the valve seat body and the injection port disk and thereby to create a throttle restriction for the heat transfer.

It is also advantageous to embody the at least one transfer element as a raised shoulder on the injection port disk, as a result of which once again the area of contact between the valve seat body and the injection port disk is reduced and the heat transfer is thus throttled. It is also advantageous to form the disk shoulder by means of an indented step or inward bulge in the injection port disk. Another advantageous feature is such that at least one transfer element is embodied as a raised shoulder on the valve seat body, and at least one transfer element is embodied as a raised shoulder on the injection port disk, to throttle the heat transfer between the valve seat body and the injection port disk. It is additionally advantageous to embody the body shoulder and the disk shoulder in circular-annular form.

It is also advantageous to press the injection port disk against the body shoulder and join them to one another, or to press the injection port disk with the disk shoulder against the valve seat body and join them together.

A likewise advantageous embodiment comprises embodying the at least one transfer element as a separate, thermally insulating insulator body, and disposing it between the valve seat body and the injection port disk, so as to reduce the amount of heat transferred from the valve seat body to the injection port disk. It is advantageous to make the injection port disk out of plastic, especially in the form of an injection-molded plastic body.

BRIEF DESCRIPTION OF THE DRAWINGS

Exemplary embodiments of the invention are shown in simplified form in the drawing and described in further detail in the ensuing description.

DESCRIPTION OF THE EXEMPLARY EMBODIMENTS

Figure 1:
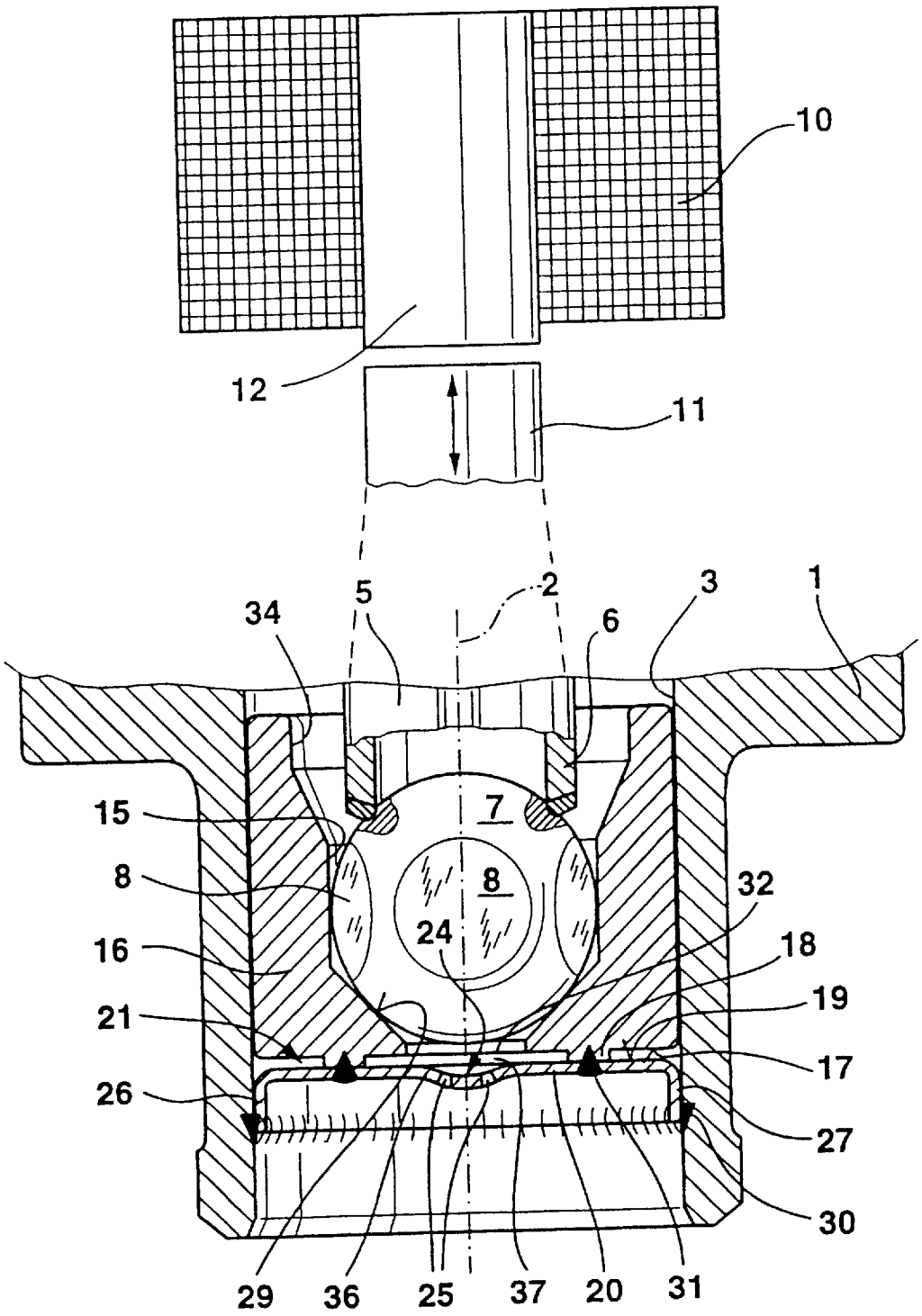
FIG. 1 shows a first exemplary embodiment of the invention in terms of a schematic fragmentary illustration of a fuel injection valve.

In FIG. 1, one example of an exemplary embodiment of a fuel injection valve for fuel injection systems in mixture-compressing internal combustion engines with externally supplied ignition is shown, which is embodied according to the invention as the first exemplary embodiment. The fuel injection valve has a tubular valve housing 1, in which a longitudinal opening 3 is formed concentrically with a longitudinal axis 2 of the valve. A valve needle 5, which for instance is tubular, is disposed in the longitudinal opening 3 and is connected on its downstream end 6 to a spherical valve closing body 7, on whose circumference flattened areas 8, for instance five of them, are provided.

The actuation of the fuel injection valve is effected in a known manner, for instance electromagnetically. Axially moving the valve needle 5 and thus opening the fuel injection valve counter to the spring force of a restoring spring, not shown, or closing it, is accomplished by an electromagnetic circuit shown in suggested fashion, having a magnet coil 10, an armature 11, and a core 12. The armature 11 is joined to the end of the valve needle 5 remote from the valve closing body 7, for instance by a laser-produced weld seam, and is aligned with the core 12.

For guiding the valve closing body 7 during the axial motion there is a cylindrical guide opening 15 of a valve seat body 16. The cylindrical valve seat body 16 is inserted into the downstream end, remote from the core 11, of the valve housing 1, in the longitudinal opening 3 extending concentrically with the longitudinal axis 2 of the valve. The circumference of the valve seat body 16 has a slightly smaller diameter than the longitudinal opening 3 of the valve housing 1. On its one lower end 17, remote from the valve closing body 7, the valve seat body 16 is provided with a raised body shoulder 18, on which a bottom part 20 of an injection port disk 21, which for instance is cup-shaped, rests with its upper face end 19 and is joined concentrically and firmly to the raised body shoulder. In its central region 24, the bottom part 20 of the injection port disk 21 has at least one and for instance four injection ports 25 formed by erosion or stamping.

The bottom part 20 of the cup-shaped injection port disk 21 is adjoined by an encompassing retaining edge 26, which extends axially in the direction away from the valve seat body 16 and is bent conically outward as far as its end 27. Since the circumferential diameter of the valve seat body 16 is smaller than the diameter of the longitudinal opening 3 of the valve housing 1, only radial pressure exists between the longitudinal opening 3 and the slightly conically outward-bent retaining edge 26 of the injection port disk 21.

The depth to which the valve seat part, comprising the valve seat body 16 and the cup-shaped injection port disk 21, is inserted determines the presetting of the stroke of the valve needle 6, since one terminal position of the valve needle 5 is determined, when the magnet coil 10 is not excited by the contact of the valve closing body 7 with a valve seat face 29 of the valve seat body 16. The other terminal position of the valve needle 5 is defined, when the magnet coil 10 is excited, for instance by the contact of the armature 11 with the core 12. The travel distance between these two terminal positions of the valve needle 5 thus represents the open stroke.

On its end 27, the retaining edge 26 of the injection port disk 21 is tightly and firmly joined to the wall of the longitudinal opening 3. To that end, an encompassing weld seam 30 is provided between the end 27 of the retaining edge 26 and the wall of the longitudinal opening 3. Outside the central region 24, the bottom part 20 is tightly joined to the body shoulder 18 at the face end 17 of the valve seat body 16 by another encompassing weld seam 31. A tight connection of the valve seat body 16 and the injection port disk 21 and of the injection port disk 21 and the valve housing 1 is necessary so that the fuel cannot flow between the longitudinal opening 3 of the valve housing 1 and the circumference of the valve seat body 16 to reach the injection ports 25, or between the longitudinal opening 3 of the valve seat carrier 1 and the retaining edge 26 of the cup-shaped injection port disk 21, directly into an air intake line of the engine.

The spherical valve closing body 7 cooperates with the valve seat face 29 of the valve seat body 16; this face tapers frustoconically in the flow direction and is embodied in the axial direction between the guide opening 15 and an outflow opening 32 in the lower face end 17 of the valve seat body 16. The valve seat body 16 has a valve seat body opening 34, toward the magnet coil 10, which has a diameter that is larger than the diameter of the guide opening 15 of the valve seat body 16.

For exact guidance of the valve closing body 7 and hence of the valve needle 5 during the axial motion, the diameter of the guide opening 15 is embodied such that the spherical valve closing body 7, outside its flattened portions 8, protrudes through the guide opening 15 with only slight radial spacing between them. The central region 24 of the bottom part 20 of the injection port disk 21 is bent out of the plane of the bottom part 20 in the downstream direction, for instance, that is, in the direction pointing away from the valve closing body 7, producing a bulge 36 in the central region. Between the face end 17 of the valve closing body 7, the valve seat face 29 and the wall of the bulge 36 or upper face end 19 of the injection port disk 21, a collection chamber 37 is formed, where when the valve closing body 7 is raised form the valve seat face 29, the fuel first arrives, before it is metered by the injection ports 25 and injected into the air intake line of the engine.

The at least one body shoulder 18 on the lower face end 17 of the valve seat body 16 forms a transfer element from the valve seat body 16 to the injection port disk 21 and throttles the heat transfer between the valve seat body and the injection port disk. The body shoulder 18 is preferably circular-annular in shape and in particular is concentric with the longitudinal axis 2 of the valve, and it reduces the area of contact between the bottom part 20 of the injection port disk 21 and the valve seat body 16. For the thermal decoupling of the injection port disk 21 from the valve seat body 16, it already suffices, if in an axial direction parallel to the longitudinal axis 2 of the valve, the height of the shoulder 18 is a few hundredths of a millimeter, for example five hundredths of a millimeter. The width of the shoulder 18 in the radial direction, that is, crosswise to the longitudinal axis 2 of the valve, is about one millimeter, for instance 0.8 mm. The location of the shoulder 18 on the lower face end 17 of the valve seat body 16 can be suitably chosen, between a location in the vicinity of the outflow opening 32 and a location in the vicinity of the diameter of the valve seat body 16, or in other words in the vicinity of the longitudinal opening 3.

Because of the lesser cross-sectional area, compared with the area of the lower face end 17, of the body shoulder 18, which serves as a transfer element between the valve seat body 16 and the injection port disk 21, a thermal decoupling and hence throttling of the heat transfer between the valve seat body and the injection port disk is attained, so that even with a hot engine, during hot starting and hot idling, the heat of evaporation of the fuel injected through the injection ports 25 suffices to cool down the injection port disk 21 in the region of the collection chamber 37, in such a way that there and at the injection ports 25 no, or virtually no vapor bubbles which lead to undesirable running performance of the engine will form.

In the drawing figures described below, those elements that remain and function the same as those in the above drawing figures are identified by the same reference numerals.

Figure 2:
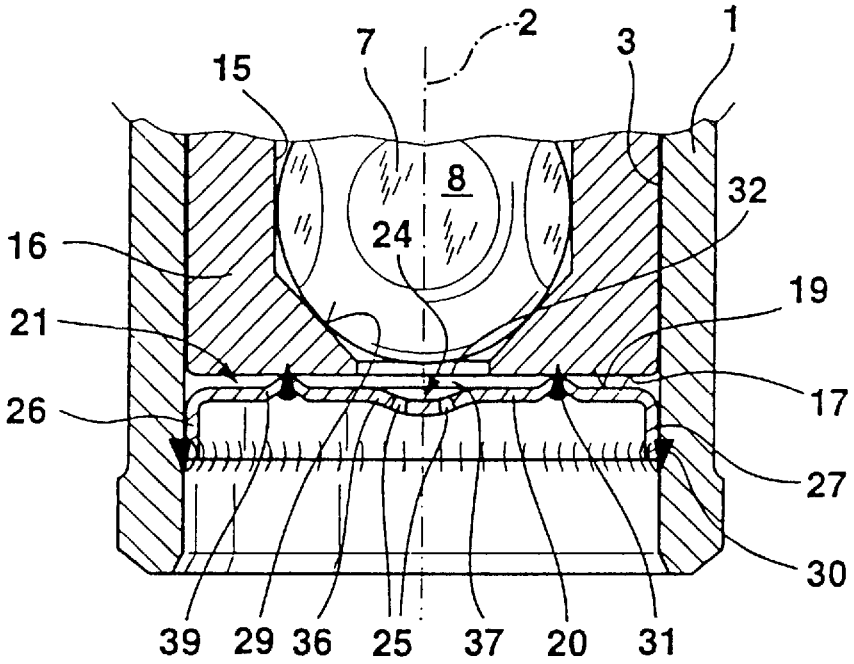
FIGS. 2–8 show a second to eighth exemplary embodiment of the invention in fragmentary views of a fuel injection valve.

FIG. 2 shows a fragmentary view of a fuel injection valve, in which there is no transfer element at the lower face end 17 of the valve seat body 16; that is, the lower face end 17 extends flat. Unlike the exemplary embodiment of FIG. 1, in the second exemplary embodiment of FIG. 2 the transfer element is embodied as a raised disk shoulder 39, which protrudes past the upper face end 19 of the bottom part 20 toward the valve seat body 16 and rests on the lower face end 17 and is joined to it by the encompassing weld seam 31. The at least one disk shoulder 39 on the bottom part 20 of the injection port disk 21, which bottom part is 0.15 mm thick as an example, is preferably embodied as circular-annular and has approximately the same dimensions as the body shoulder 18 in the first exemplary embodiment. By means of the disk shoulder 39, once again thermal decoupling between the valve seat body and the injection port disk and hence throttling of the heat transfer is attained. The location of the disk shoulder 39 can be suitably chosen, between one in the vicinity of the outflow opening 32 of the valve seat body 16 and one in the vicinity of the diameter of the injection port disk 21.

Figure 3:
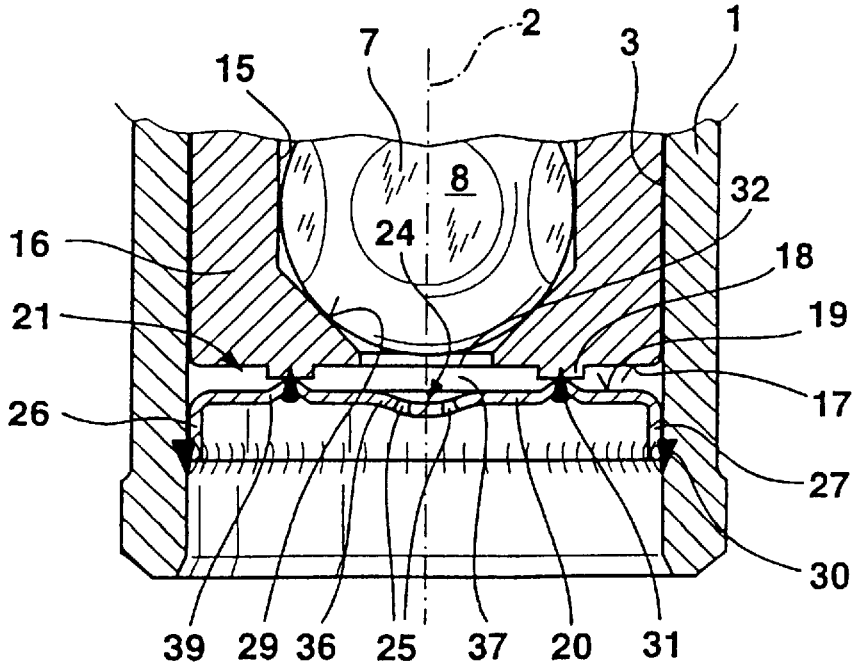

In the third exemplary embodiment of FIG. 3, the exemplary embodiments of FIGS. 1 and 2 are combined, with both a body shoulder 18 on the valve seat body 16 and a disk shoulder 39 on the bottom part 20 of the injection port disk 21 acting as the transfer element; the disk shoulder 39 rests on the body shoulder 18 and is tightly joined to it by means of the encompassing weld seam 31.

Figure 4:
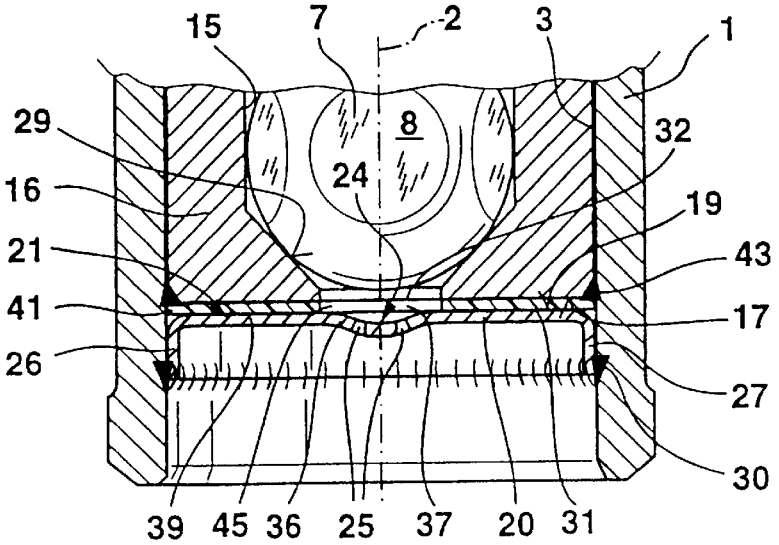
Figure 5:
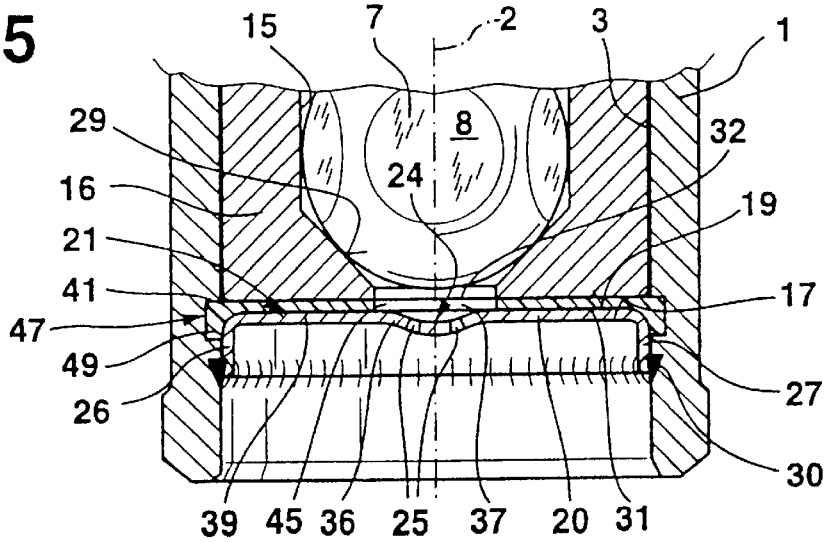
Figure 6:
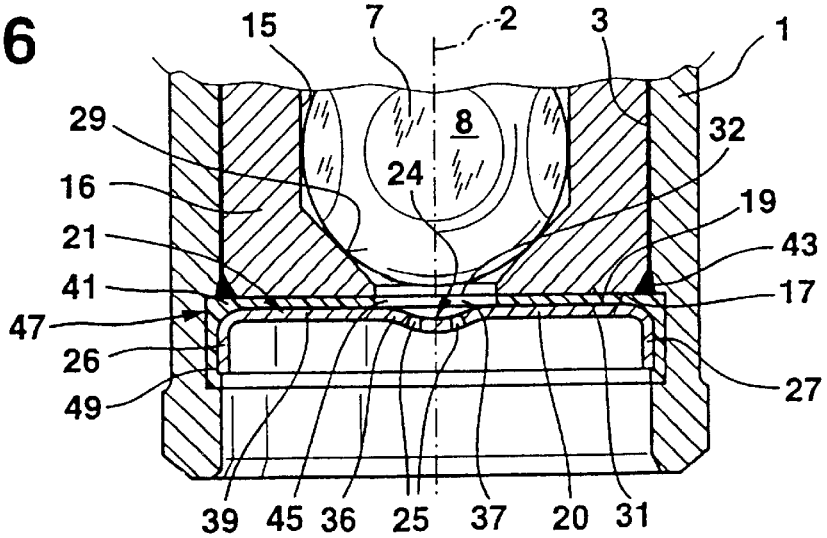

In the exemplary embodiments of FIGS. 4–6, the lower face end 17 of the valve seat body 16 is embodied as flat; nor is there any raised portion on the upper face end 19 of the injection port disk 21. Unlike the exemplary embodiments described thus far, in the exemplary embodiments of FIGS. 4–6 there is at least one transfer element between the valve seat body 16 and the injection port disk 21, embodied as a separate, thermally insulating insulator body 41, which reduces the heat transfer between the valve seat body and the injection port disk, as a result of which the development of vapor bubbles in the collection chamber 37 or at the injection ports 25 is reduced or avoided entirely. To adjust the stroke of the valve closing body 7, the valve seat body 16 can either be pressed with a press fit into the longitudinal opening 3 of the valve housing 1, as shown in FIG. 5, or else the valve seat body 16 is fixed after the adjustment by means of a weld seam 43, shown in FIGS. 4 and 6, on the lower face end 17, between the valve seat body 16 and the valve housing 1. Plastic, rubber, glass, ceramic or some other insulating material can be used as the material for the insulator body 51.

In the fourth exemplary embodiment of FIG. 4, the insulator body 41 has a flat disk shape, with a through hole 45 connecting the outflow opening 32 with the central region 24 of the bottom part 20.

In the fifth exemplary embodiment of FIG. 5, a groove 47 is formed in the region of the lower face end 17 of the valve seat body 16 in the valve housing 1; in this exemplary embodiment, this groove extends axially parallel to the longitudinal axis 2 of the valve only far enough that it does not reach the end 27 of the retaining edge 26 of the injection port disk 21, so that the end 27 can rest on the wall of the longitudinal opening 3 and be welded to it by the weld seam 30. With a cylindrical edge 49, the insulator body 41, which here is cup-shaped, engages the groove 47. The insulator body 41 of FIG. 5 may for instance be of plastic and may be made by direct injection molding in the longitudinal opening 3. Next, the injection port disk 21 is thrust into the longitudinal opening 3 and welded with the weld seam 30.

In the sixth exemplary embodiment of FIG. 6, the insulator body 41 is again cup-shaped, and both the groove 47 and the cylindrical edge 49 extend axially, beginning at the valve seat body 16, past the end 27 of the injection port disk 21, so that except in its central region 24 the injection port disk 21 is entirely surrounded on its outer surface by the insulator body 41. On insertion, the end 27 of the injection port disk 21 digs into the cylindrical edge 49 of the insulator body 41. the insulator body 41 of the exemplary embodiment of FIG. 6 can likewise be produced by plastic injection molding.

Figure 7:
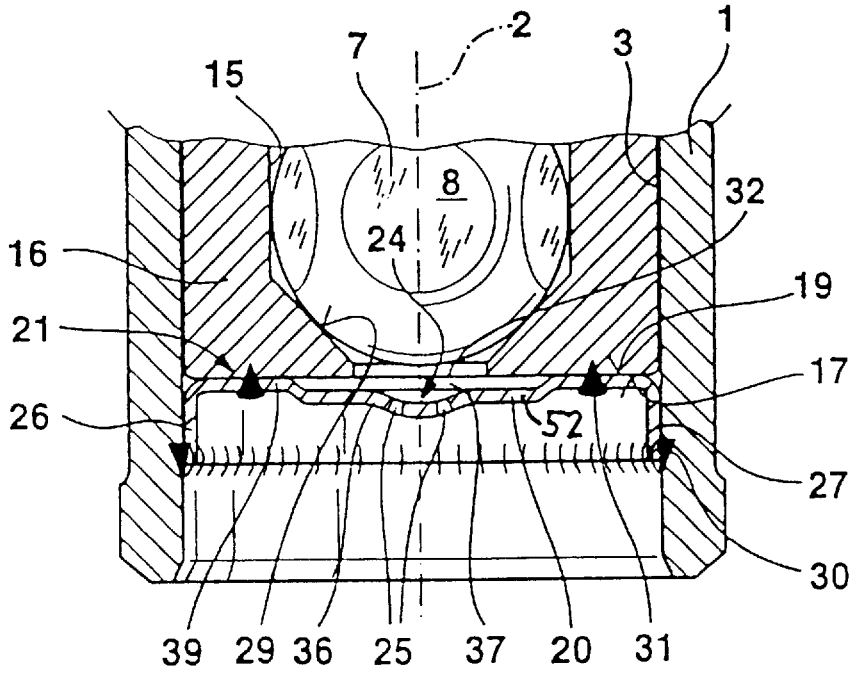

In the seventh exemplary embodiment of FIG. 7, an indented step 52 is made, for instance by embossing, in the upper face end 19 of the bottom part 20; it surrounds the central region having the at least one injection port 25 with a larger diameter, so that the disk shoulder 39 is formed, beginning at the step 52 and extending to the circumference of the bottom part 20, and rests on the lower face end 17 of the valve seat body 16.

Figure 8:
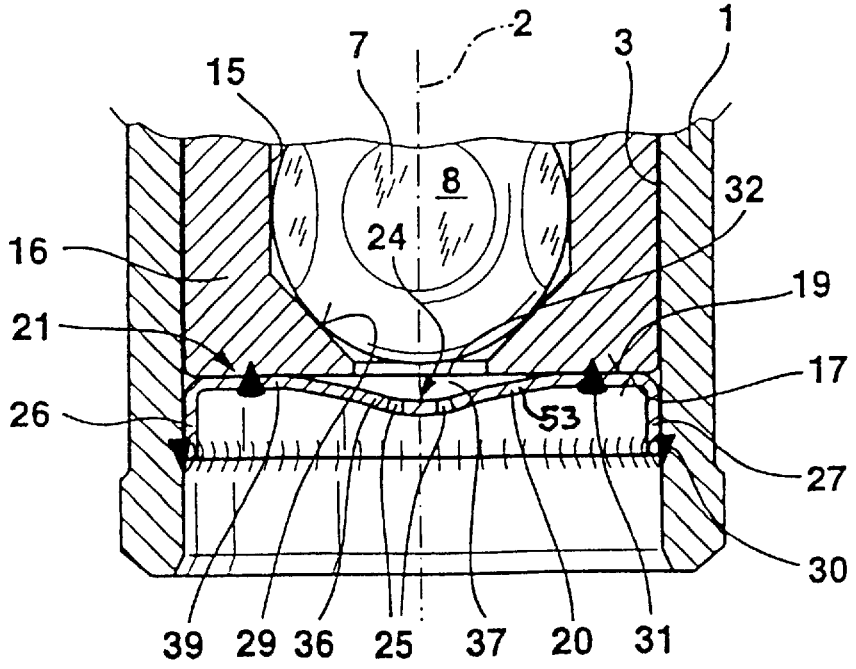

In the eighth exemplary embodiment of FIG. 8, an indented inward bulge 53 is made, for instance by embossing, in the upper face end 19 of the bottom part 20; it surrounds the central region having the at least one injection port 25 with a larger diameter, so that the disk shoulder 39 is formed, beginning at the bulge 53 and extending to the circumference of the bottom par 20, and rests on the lower face end 17 of the valve seat body 16.

All the exemplary embodiments both of FIGS. 1–3 and FIGS. 7–8 have in common the fact that by the embodiment of the body shoulder 18 or the disk shoulder 39 and the cross section of the injection port disk 21, which for instance is only 0.15 mm thick, the heat flow to the central region is reduced and hence the danger of vapor bubble development is lessened.

It is likewise possible, in the exemplary embodiments of FIGS. 1–3 and 7 and 8, to provide a suitable thermally insulating insulator body in the region of the body shoulder 18 and/or the disk shoulder 39.

The ways of attaining the object of the invention that have been described in terms of the exemplary embodiments are not suitable only for cup-shaped injection port disks; they are equally applicable to injection port disks that are embodied as entirely flat.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of: the United States is:

1. A fuel injection valve for internal combustion engines, comprising a valve housing, a movable valve closing body, said movable closing body cooperates with a valve seat face that is formed in a valve seat body, said valve seat body includes an outflow opening (32) adjacent said valve seat face, an injection port disk disposed downstream of the valve seat body, at least one injection port is provided in said injection port disk, heat transfer between the valve seat body (16) and the injection port disk (221) is reduced by at least one heat transfer element (18, 39) in said fuel injection valve, said at least one heat transfer element is arranged in a radial direction with a gap between the at least one heat transfer element and the outflow opening (32), and said heat transfer element is embodied as a raised body shoulder (18) on the valve seat body (16).

2. The fuel injection valve in accordance with claim 1, in which at least one additional heat transfer element is embodied as a raised disk shoulder (39) on the injection port disk (21).

3. The fuel injection valve in accordance with claim 2, in which the injection port disk (21) has an upper face end (19), toward the valve seat body (16), that has a central region (24) that in turn has at least one injection port (25), and for forming the disk shoulder (39) originating at the circumference, the injection port disk has a step (52) that is indented relative to the upper face end (19) and that surrounds the central region (24) with a larger diameter.

4. The fuel injection valve in accordance with claim 2, in which the injection port disk (21) has an upper face end (19), toward the valve seat body (16), that has a central region (24) that in turn has at least one injection port (25), and for forming the disk shoulder (39) originating at the circumference, the injection port disk has an inward bulge (53) that is indented relative to the upper face end (19) and that surrounds the central region (24) with a larger diameter.

5. The fuel injection valve in accordance with claim 1, in which the body shoulder (18) is embodied as circular-annular in shape.

6. The fuel injection valve in accordance with claim 2, in which the disk shoulder (39) is embodied as circular-annular in shape.

7. The fuel injection valve in accordance with claim 1, in which the disk shoulder (39) is embodied as circular-annular in shape.

8. The fuel injection valve in accordance with claim 1, in which the injection port disk (21) rests on the body shoulder (18) and is joined to it.

9. The fuel injection valve in accordance with claim 2, in which the injection port disk (21) rests with the disk shoulder (39) on the valve seat body (16) and is joined there to the valve seat body.

10. A fuel injection valve for internal combustion engines, comprising a valve housing, a movable valve closing body, said movable valve closing body cooperates with a valve seat face that is formed in a valve seat body, an injection port disk disposed downstream of the valve seat body, at least one injection port is provided in said injection port disk, heat transfer between the valve seat body (16) and the injection port disk (21) is reduced by at least one heat transfer element in said fuel injection valve, said at least one heat transfer element is embodied as a raised disk shoulder (39) on the injection port disk (21), and said disk shoulder is joined to the valve seat body.

11. The fuel injection valve in accordance with claim 10, in which the injection port disk (21) has an upper face end (19), toward the valve seat body (16), that has a central region (24) that in turn has at least one injection port (25), and for forming the disk shoulder (39) originating at the circumference, the injection port disk has a step (52) that is indented relative to the upper face end (19) and that surrounds the central region (24) with a larger diameter.

12. The fuel injection valve in accordance with claim 1, in which the disk shoulder (39) is embodied as circular-annular in shape.

13. The fuel injection valve in accordance with claim 11, in which the injection port disk (21) rests with the disk shoulder (39) on the valve seat body (16) and is joined there to the valve seat body by a weld seam.

14. The fuel injection valve in accordance with claim 10, in which the injection port disk (21) has an upper face end (19), toward the valve seat body (16), that has a central region (24) that in turn has at least one injection port (25), and for forming the disk shoulder (39) originating at the circumference, the injection port disk has an inward bulge (53) that is indented relative to the upper face end (19) and that surrounds the central region (24) with a larger diameter.

15. The fuel injection valve in accordance with claim 14, in which the disk shoulder (39) of the injection port disk (21) is joined to the valve seat body a weld seam.

16. The fuel injection valve in accordance with claim 10, in which the disk shoulder (39) is embodied as circular-annular in shape.

17. The fuel injection valve in accordance with claim 10, in which the disk shoulder (39) of the injection port disk (21) is joined to the valve seat body by a weld seam.

18. A fuel injection valve for internal combustion engines, comprising a valve housing, a movable valve closing body, said movable valve closing body cooperates with a valve seat face that is formed in a valve seat body, said valve seat body includes an outflow opening (32) adjacent said valve seat face, an injection port disk disposed downstream of the valve seat body, at least one injection port is provided in said injection port disk, heat transfer between the valve seat body (16) and the injection port disk (21) is reduced by at least one heat transfer element in said fuel injection valve, said at least one heat transfer element is embodied as a separate, thermally insulating insulator body (41) and is disposed between the valve seat body (16) and the injection port disk (21), a through hole (45) in said insulator body, said through hole has a cross section which is similar to a cross section of the outflow opening (32).

19. The fuel injection valve in accordance with claim 18, characterized in that the insulator body (41) is embodied of plastic, ceramic or glass.

* * * * *